US011506370B2

(12) United States Patent
Nölle

(10) Patent No.: US 11,506,370 B2
(45) Date of Patent: Nov. 22, 2022

(54) LUMINAIRE FOR WORK EVENTS, FILM EVENTS OR SPORTS EVENTS

(71) Applicant: Jürgen Nölle, Rheinberg (DE)

(72) Inventor: Jürgen Nölle, Rheinberg (DE)

( * ) Notice: Subject to any disclaimer, the term of this patent is extended or adjusted under 35 U.S.C. 154(b) by 0 days.

(21) Appl. No.: 17/268,451

(22) PCT Filed: Aug. 15, 2019

(86) PCT No.: PCT/DE2019/200099
§ 371 (c)(1),
(2) Date: Feb. 13, 2021

(87) PCT Pub. No.: WO2020/035118
PCT Pub. Date: Feb. 20, 2020

(65) Prior Publication Data

US 2021/0262645 A1 Aug. 26, 2021

(30) Foreign Application Priority Data

Aug. 17, 2018 (DE) ..... 102018006506.6

(51) Int. Cl.
*F21V 29/75* (2015.01)
*F21S 2/00* (2016.01)
(Continued)

(52) U.S. Cl.
CPC ..... *F21V 21/30* (2013.01); *F21S 2/005* (2013.01); *F21V 29/75* (2015.01); *F21W 2131/1005* (2013.01); *F21Y 2115/10* (2016.08)

(58) Field of Classification Search
CPC ..... F21V 21/30; F21V 29/75; F21S 2/005; F21Y 2115/10; F21W 2131/005
See application file for complete search history.

(56) References Cited

U.S. PATENT DOCUMENTS

2009/0244894 A1 10/2009 Zhou
2012/0134155 A1 5/2012 Philips
(Continued)

FOREIGN PATENT DOCUMENTS

DE 102018125401 A1 * 4/2020
WO 2010119378 A1 10/2010
(Continued)

*Primary Examiner* — Anabel Ton
(74) *Attorney, Agent, or Firm* — Michael Soderman

(57) ABSTRACT

The invention relates to a luminaire (20) for work events, film events or sports events. According to the invention, in order to produce a robust and simple construction of a luminaire (20), while also providing high flexibility in the use thereof and reduced power consumption, the at least one LED module (1) of such a luminaire (20) has an approximately triangular, flat basic form, a lateral surface being fitted with LEDs, preferably power LEDs, and the rear side of the LED module (1) being designed to emit thermal radiation. Connecting elements are formed on one of the side edges, which connecting elements are used by means of suitable retaining elements (21) to construct the luminaire (20). The particular advantage of the luminaire (20) is that high light intensity can be achieved in the field of use of the luminaires (20), namely for work events, film events or sports events. Because of the pivotability of individual LED modules (1), the area to be illuminated can additionally be influenced.

14 Claims, 10 Drawing Sheets

(51) Int. Cl.

| | |
|---|---|
| ***F21V 21/30*** | (2006.01) |
| *F21Y 115/10* | (2016.01) |
| *F21W 131/10* | (2006.01) |

(56) References Cited

U.S. PATENT DOCUMENTS

| | | | | |
|---|---|---|---|---|
| 2014/0133149 | A1 | 5/2014 | Sergio | |
| 2014/0168983 | A1 | 6/2014 | Opsomer | |
| 2014/0198504 | A1 | 7/2014 | Philips | |
| 2016/0047538 | A1* | 2/2016 | Peck | F21V 23/009 362/249.02 |

FOREIGN PATENT DOCUMENTS

| | | | | |
|---|---|---|---|---|
| WO | 2011015971 | A1 | 2/2011 | |
| WO | 2012001505 | A2 | 1/2012 | |
| WO | WO-2017109636 | A1 * | 6/2017 | F21S 2/005 |
| WO | WO-2017181291 | A1 * | 10/2017 | F21V 23/06 |

* cited by examiner

LUMINAIRE FOR WORK EVENTS, FILM EVENTS OR SPORTS EVENTS

CROSS REFERENCE TO RELATED APPLICATIONS

This application is the U.S. national stage of International Application No. PCT/DE2019/200099, filed on 2019 Aug. 15. The international application claims the priority of DE 102018006506.6 filed on 2018 Aug. 17; all applications are incorporated by reference herein in their entirety.

BACKGROUND

The invention relates to a luminaire for work events, film events or sports events, comprising at least one retaining element to which at least one LED module is pivotably fastened and can be supplied with a voltage via leads.

Luminaires are offered in a variety of types, for example as interior luminaires in the form of ceiling- or wall-mounted luminaires. The luminaires may accommodate one or more lamps which can be supplied with voltages. The luminaires consist either of glass, ceramics, or plastics, wherein a lampshade can be additionally provided which optionally has a frame with a fabric cover. Apart from this, recessed luminaires are known which are embedded either into a wall or into a ceiling. All of these luminaires are mainly usable indoors. Furthermore, there are various housing shapes for luminaires which are employed outdoors, for example as gardening illumination or house illumination in the form of recessed luminaires, wherein an assembly of the recessed luminaires can be accomplished in a roof superstructure or in an entrance area. Moreover, watertight designs of various gardening luminaires are embedded into the ground or existing terrace surfaces. In the external area, it is necessary for this to observe the regulations in view of humidity protection. Many of the luminaires are provided for stationary assembly and are not transportable.

Apart from this, there is a market for high-performance luminaires which are used, for example, for illuminating working areas, or as film equipment or in sports events. In such cases, high light intensity is important, as such luminaires are typically arranged at rather great heights of more than 3 m, in individual cases even above 10 m. Moreover, such luminaires might be fastened to a stand and can thus be positioned for the different intended applications at the required height.

Due to amendments to the regulations and, in some cases, the elimination of lamps, for example halogen lamps, it is necessary to develop a new luminaire concept which is mainly directed to LEDs. On the one hand, light intensity is to be increased thereby, and on the other hand, power consumption is to be reduced as much as possible.

SUMMARY

Therefore, it is an object of the present invention to provide a novel luminaire as work, film or sports events luminaire which is characterised by a robust and simple construction and provides high flexibility in the outdoor use.

To achieve the object, the at least one LED module has an approximately triangular, flat basic form, a lateral surface being fitted with LEDs, preferably power LEDs, and the rear side of the LED module being designed to emit thermal radiation, wherein at least on one side edge, connecting elements for the retaining element are provided, and the retaining element consists of one polygonal frame or two straight fastening supports. Further advantageous embodiments of the invention can be taken from the subclaims.

DETAILED DESCRIPTION

By the use of an approximately triangular, flat LED module, an extremely compact luminaire is created which is easy to transport and offers the possibility of being employed as wall, ceiling, or outdoor luminaire. The complete construction is kept flat by the basic form of the LED modules used and does not result in any restrictions in the assembly. These advantages normally do not exist with a stationary assembly, while in contrast, the at least one LED module may equally be used for variably erected luminaires. The LED modules have connecting elements for a retaining element at one side edge, so that on the one hand, a stationary assembly is possible, but due to the eyelets, a pivoting of individual LED modules is also possible. In such a case, the retaining element is designed such that it can receive or support the connecting elements of the LED modules, wherein due to an extremely stable design, sufficient support can be ensured by the connecting elements if the retaining element or retaining pieces are simultaneously optionally mounted to a wall or a ceiling, or are possibly employed to be used with a stand.

Another advantage results from the fact that the luminaire is exclusively fitted with LEDs, so that in the external area, a low voltage can be used. A movable linkage of an LED module to the retaining element or retaining pieces furthermore permits the orientation of the LED modules in a desired direction and a quick possibility of reorientation, if necessary. By the selection of a suited retaining element and suited connecting elements, the pivotability of the LED modules is moreover ensured, whereby, starting from a fixed location, a change of the orientation of the illumination is possible.

A further development of the invention provides for a plurality of LED modules to be joined and connected to a semicircle or full circle via the retaining element. Here, a connection is accomplished, for example, via the connecting elements and one retaining element, wherein all LED modules can be supplied with a voltage via a power cord. By the arrangement of the LED modules to a semicircle or full circle, it is possible to achieve high light intensity within a very restricted space, as it is required, for example, as work luminaire. As an alternative, it is possible that a plurality of LED modules is joined and connected via the retaining element in a strip form. Such an arrangement of the LED modules permits the manufacture of a light band which is mounted to a wall or preferably to a ceiling, wherein, given a corresponding size, several ones of the light bands can be arranged spaced apart at the ceiling. The light intensity of the LED modules is so high that not only small but even large halls can be completely illuminated. To supply the LED modules with a voltage, the at least one LED module is supplied with a supply voltage via a cable connection, or several LED modules are interconnected and can be supplied with a supply voltage at least via one cable connection.

In a further development of the invention, the retaining element consists of a polygonal frame which extends over 180° or 360°. A polygonal frame is employed because the LED modules are triangular and are fastened to the retaining element or retaining pieces with one side edge. To cover an arc of 180°, in such a case, three LED modules with at least three straight sections of the retaining element are required.

If an arc of 360° is to be achieved, the number of LED modules required is correspondingly twice as high. Here, in a further development of the inventive idea, it is easily possible that two polygonal frames of 180° each are connected to each other via a joint, so that by folding open these two frames, a full circle of 360° is achieved. By this measure, transport will be essentially easier to handle and thus facilitated.

In a further development of the invention, the retaining element consists of two fastening supports which are fastened to the wall or ceiling and receive a plurality of neighbouring LED modules such that a light band is formed. To this end, the individual LED modules are arranged alternately in opposite directions with an apex of the triangle formed by the two equal-sided side edges. The length of such a light band is not relevant in this case and can be optionally extended subsequently. The light bands are preferably employed in production halls where high light intensity is desired, for example in aeroplane assembly.

In case of polygonal frames that extend over 180° or 360°, the at least one, preferably several, LED module(s) can be at least partially pivoted about the frame, whereby the area to be illuminated will be influenced. With a full circle of 360°, at a corresponding height of the luminaire, an illumination of a nearly circular area on the floor results. If opposed LED modules are partially pivoted, the illumination of a circular shape can pass over into an elliptic shape thereby. Such illumination areas are preferably required for road or rail construction. A completely fitted luminaire in a 360°-design here reaches 155,000 Lumen.

In a further development of the invention, the apices of the triangle can be lifted or lowered in a direction perpendicular to the LED module. By pivoting the modules out of the LED module's plane, it is possible to vary the area to be illuminated, wherein, depending on the selected assembly of the luminaire, the individual LED modules are either lifted or lowered with their apices out of the module plane. If all LED modules are pivoted completely, the radius of the light cone can be enlarged. By lifting or lowering the individual LED modules, these may be set up to a pyramid or conical form. To achieve sufficient stability in the respective position of the LED modules, the lifted triangular apices are adjustable continuously, or lockable in a plurality of locking stages. This prevents, for example, that in case of arising wind loads, individual LED modules are moved out of the original deflection.

A locking of the triangle apices of an LED module may be effected, for example, by a metal band which is arranged between two permanent magnets, wherein the metal band is connected to the bushing via a joint, and the metal band has a curvature at its free end leading to a compensating movement when the LED modules are lifted, and the metal band remains between the permanent magnets.

For stability reasons and to facilitate the construction, the at least one LED module is equipped with eyelets which receive a retaining element in the form of a tube, a round strut, or a round fastening support. Thus, the LED modules can be pivoted about the bow, the strut, or the fastening support, respectively, whereby by a corresponding size of the respective eyelets and retaining element or retaining pieces, an excellent stability is achieved. The retaining element can consist, for example, of a round fibre, glass fibre or carbon fibre rod. To achieve a construction extending over 180° or 360°, the fibre, glass fibre, or carbon fibre rods are connected to each other via corner connectors. The corner connectors themselves are connected to a central part via tensioning wires, similar to a wheel hub, so that after the joining of all components of the retaining element or retaining pieces, a pre-tension directed to the centre is achieved to provide the required strength. The central part here takes the function of a hub as it is present in a wheel.

To assemble the LED modules, the rods are to this end previously pushed through the existing eyelets of the LED modules and inserted into existing bores of the corner connectors and fixed by means of screws. To this end, the supporting rods have a diameter corresponding to the inner diameter of the eyelet. In addition, between the eyelets and laterally of the LED modules, bushings are pushed up to the corner connectors, so that a lateral slipping of the LED modules is prevented. The eyelets of the LED modules are additionally arranged laterally offset from the centre, so that, for example, two LED modules may be fastened to one tube if a design other than a hexagonal shape is desired. The fibre, glass fibre, or carbon fibre rods as tubes here have the function of a guide rod, while the pushed-on bushings perform a lateral fixing between the corner connectors.

By the LED modules being equipped with a plurality of individual LEDs, preferably power LEDs, the dissipation of the heat formed is obligatory. For this reason, the rear side of the LED modules is equipped with cooling fins, while the front side of the LED modules is provided with a plastic cover. The plastic cover is of a diffused design for light scattering purposes to reduce the baffling effect of individual LEDs. Moreover, the plastic cover can be provided with punctual or linear elevations, or optionally with corrugations, thus achieving a surface enlargement and thereby an improvement in light scattering.

In a further development of the invention, the at least one LED module is equipped with LEDs of different colours, in particular RGB colours. This makes it possible to have each individual LED module or groups of LED modules light up in different colours. It is moreover possible to perform a continuous change of colours and to adapt the colours to the intended purpose. It is furthermore provided that the at least one LED module can be dimmed to perform brightness control, where preferably a GMX controller is used by which the individual LED modules are controlled.

To install the luminaire in a 180° or preferably 360° arrangement of the individual LED modules at a selected working height, the central part in the form of a bushing is furthermore used as fastening means, wherein a stationary assembly or a variable, height-adjustable assembly via a stand is possible. Via a Bluetooth connection, it is possible to switch the luminaire on and off, and to dim it. Moreover, it is also possible to adjust a certain colour spectrum.

The present invention is characterised by a high adaptation flexibility and an extremely stable construction, whereby it will meet the provided intended purpose in the field of work luminaires, film, or sports events. Individual luminaires can here be embodied as polygonal luminaries extending over 180° or 360°, respectively. As an alternative, it is possible to produce a light band by the LED modules which can be used for illuminating large halls, wherein arbitrary lengths are possible. The stability of the luminaire is achieved in that a hub is provided in the centre and individual retaining element or retaining pieces are polygonally connected by means of corner connectors, wherein the corner connectors can be additionally tensioned with the central part by tensioning wires, and thus the design of the luminaire will lead to a high stability after its assembly. Of course, the individual wires can be re-tensioned, if required, to protect them from material wear or to exchange individual LED luminaires. By the dimmability and the adjustment of the colour temperature, the luminaire can be adjusted to the required demands, whereby a high degree of application possibilities is ensured.

The invention will be further illustrated more in detail with reference to the figures.

DETAILED DESCRIPTION OF THE PREFERRED EMBODIMENTS

Figure 1:
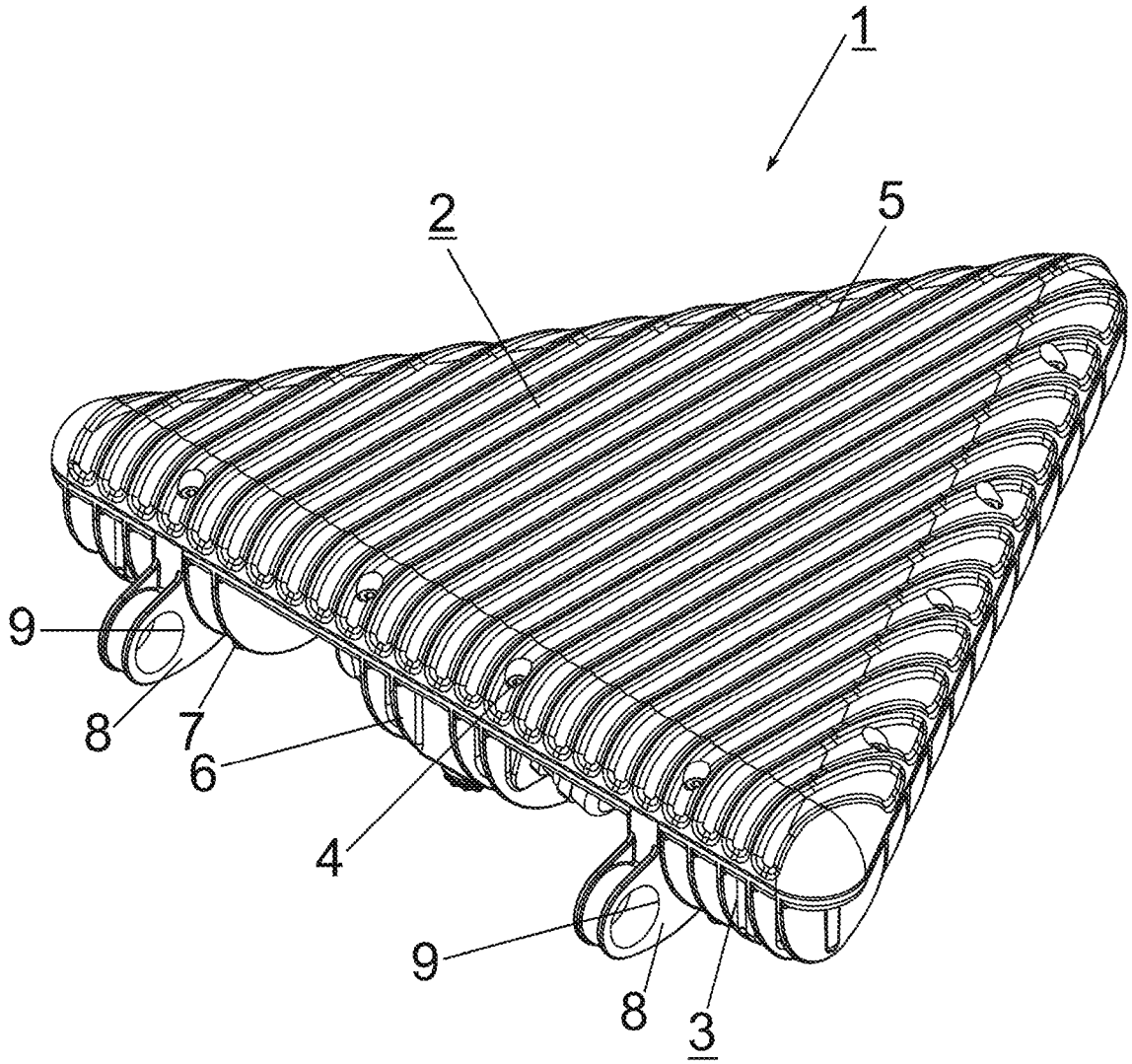
FIG. 1 shows a perspective plan view onto an individual LED module.

FIG. 1 shows an LED module 1 in a perspective plan view which consists of a light-transparent plastic cover 2 and a rear heat sink 3. The shape of the LED module 1 is an equal-sided triangle, so that several LED modules 1, arranged one next to the other, can be joined to a semicircle or full circle, or to a light band, respectively, wherein in case of the light band, the LED modules 1 are arranged alternately with their respective apices. The shape of the LED module is an equal-sided triangle, so that a joining of the side edges of the same lengths is possible without any problems. The upper plastic cover 2 is bolted to the heat sink 3 via studs 4, the heat sink 3 simultaneously forming the rear side of the LED module 1. The plastic cover 2 here preferably consists of a translucent material so that the light emitted by the power LEDs can exit through the plastic cover 2 to the outside in a scattered manner. To enlarge the surface, the plastic cover 2 is provided with straight rounded elevations 5 at equidistant distances. The elevations 5 pass over into a curved form in the marginal region, following the shape of the plastic cover 2. The heat sink 3 consists of individual cooling fins 6 which are arranged at the rear side across the complete width of the LED module 1. The cooling fins 6 are straight in the central region and are provided with a rounding 7 in the edge region. Two integrally formed eyelets 8 with a bore 9 permit to fix one individual LED module via a non-depicted retaining element. By the eyelets 8 with bores 9, it is here possible to arrange the LED modules 1 in a plane in which the retaining element is also arranged, wherein the individual LED modules 1 can be pivoted out of the plane. During the construction of a luminaire having six individual LED modules 1 extending over 360°, it is thus possible to lift the apices of the LED modules 1 directed to the centre, whereby the shape of a pyramid is formed.

By the pivotability of the LED modules 1, a variable light cone can be adjusted, taking into consideration the height where the LED modules 1 are arranged.

In a normal case, when all LED modules 1 are lying in the plane, the illumination will be circular and can optionally be enlarged in its diameter by pivoting all LED modules 1. By pivoting two LED modules 1 located opposed to each other, the illuminated area can be transferred from the round shape to a nearly elliptic shape. Such an illumination is required, for example, in repair works in road and rail construction.

Figure 2:
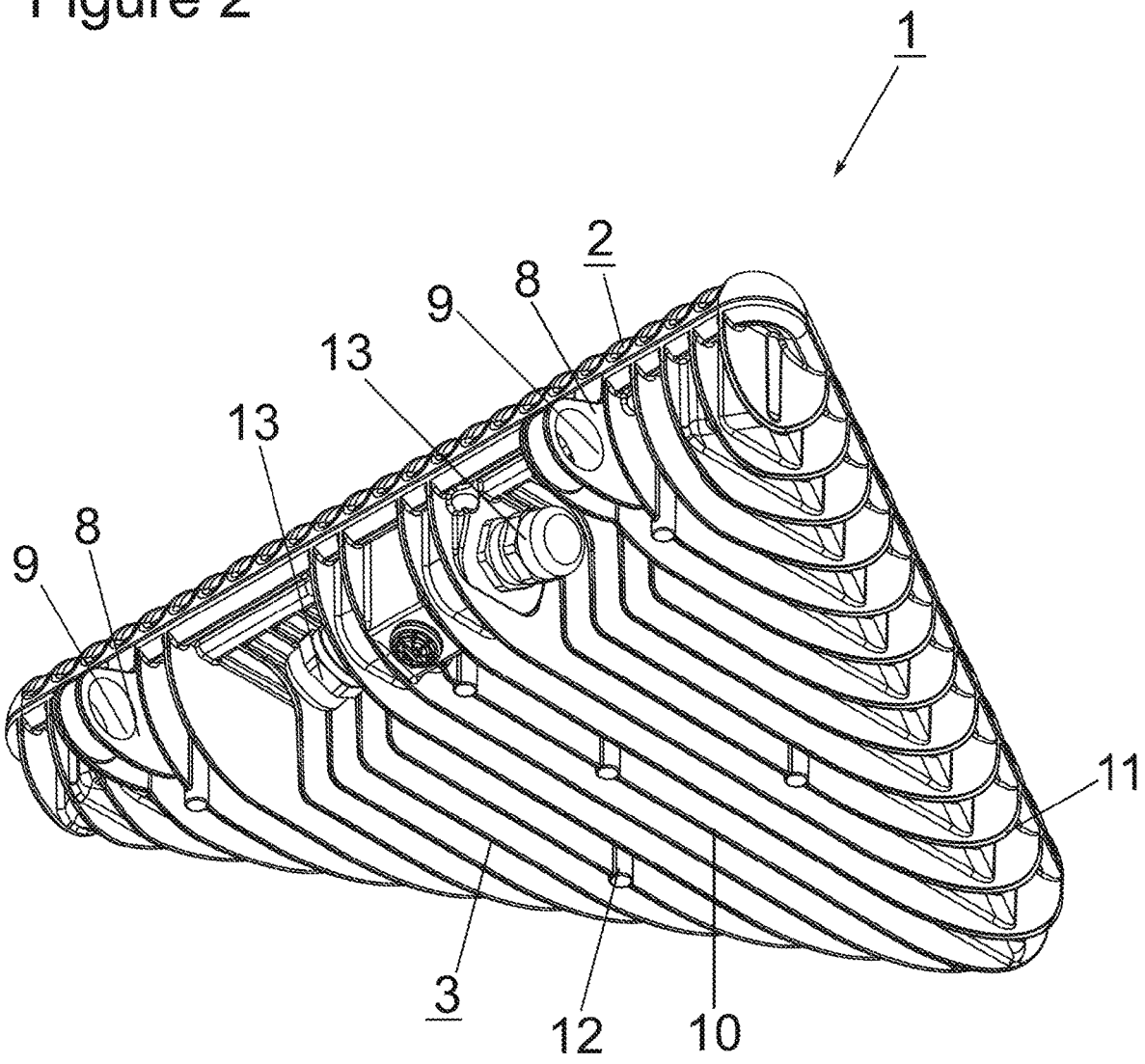
FIG. 2 shows a perspective bottom view of an individual LED module.

FIG. 2 shows the LED module 1 with the upper plastic cover 2 and the heat sink 3 in a perspective bottom view. From this view, it is clear that the heat sink 3 shows a straight, linear edge extension 10 of the cooling fins 6 in the central region of the LED luminaire 1, while this edge extension passes over into a curvature 11 in the marginal region. To avoid damages of the individual cooling fins 6, a plurality of integrally formed supports 12 are provided which slightly project over the cooling fins 6. This prevents individual cooling fins 6 from being bent which can easily occur in the harsh handling on a construction site. A voltage cable can be connected via screwed connections 13 which are standard PG screwed joints. Here, it is possible that one individual LED module 1 is connected with a cable, but a connection to further LED modules can be equally established by means of the second screwed connection 13 if these are, for example, assembled to a luminaire in a 360° arrangement. By the eyelets 8 with bores 9 and a suited retaining element, a pivoting relative to the retaining element is possible to orient the individual LED modules 1 to a certain geometric shape. By the size of the cooling fins 15 it is here ensured that there is a large surface to dissipate the arising heat of the power LEDs arranged underneath the plastic cover 2.

Figure 3:
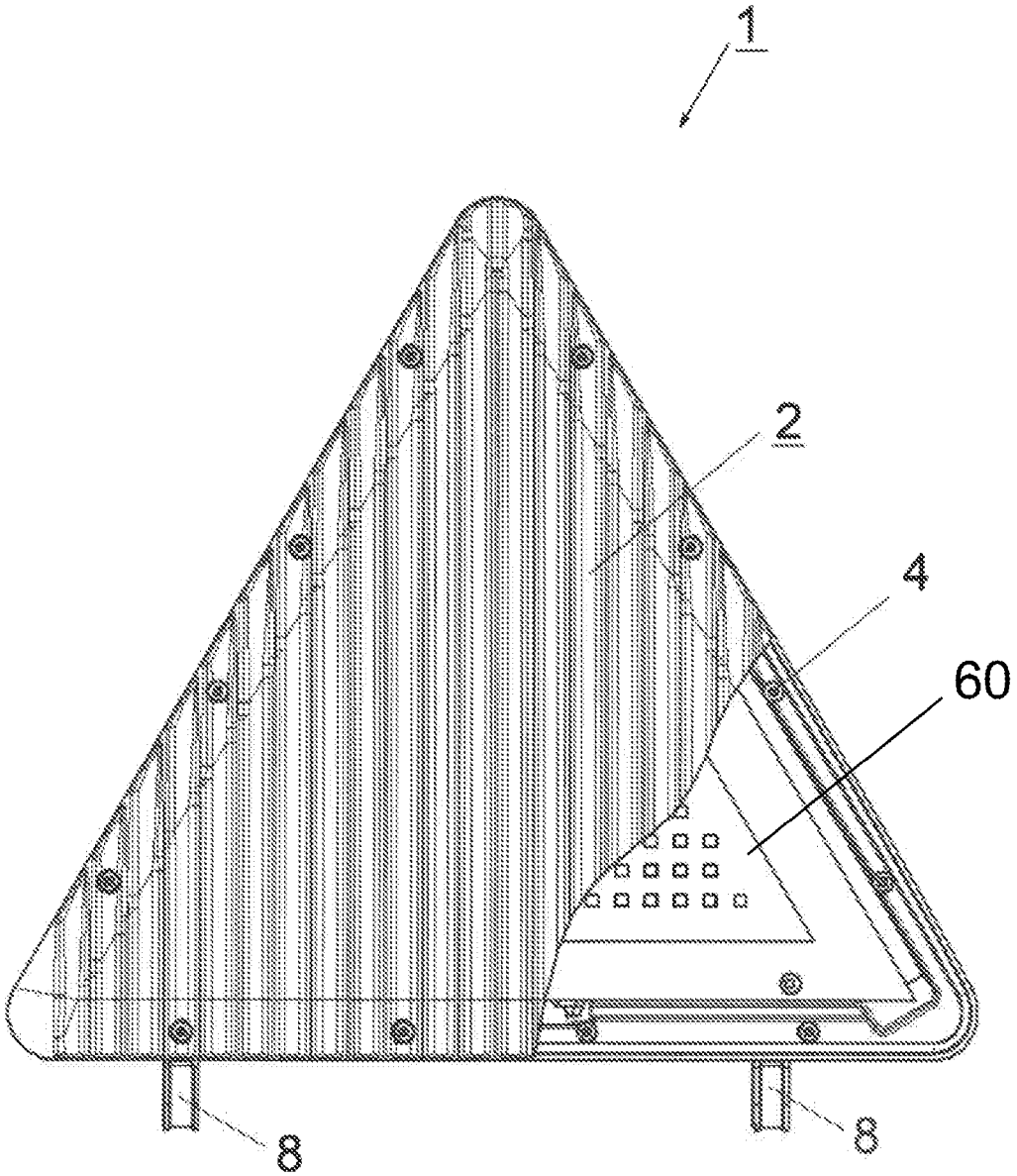
FIG. 3 shows a plan view onto the LED module according to FIG. 1.

FIG. 3 shows a plan view of an LED module 1 with a view onto the plastic cover 2. Bolting to the rear side, namely the heat sink 3, is effected by the studs 4 which are arranged distributed for the complete edge region of the LED luminaire 1. The two eyelets 8 permit to pivot the individual LED modules 1 within a suited retaining element.

Figure 4:
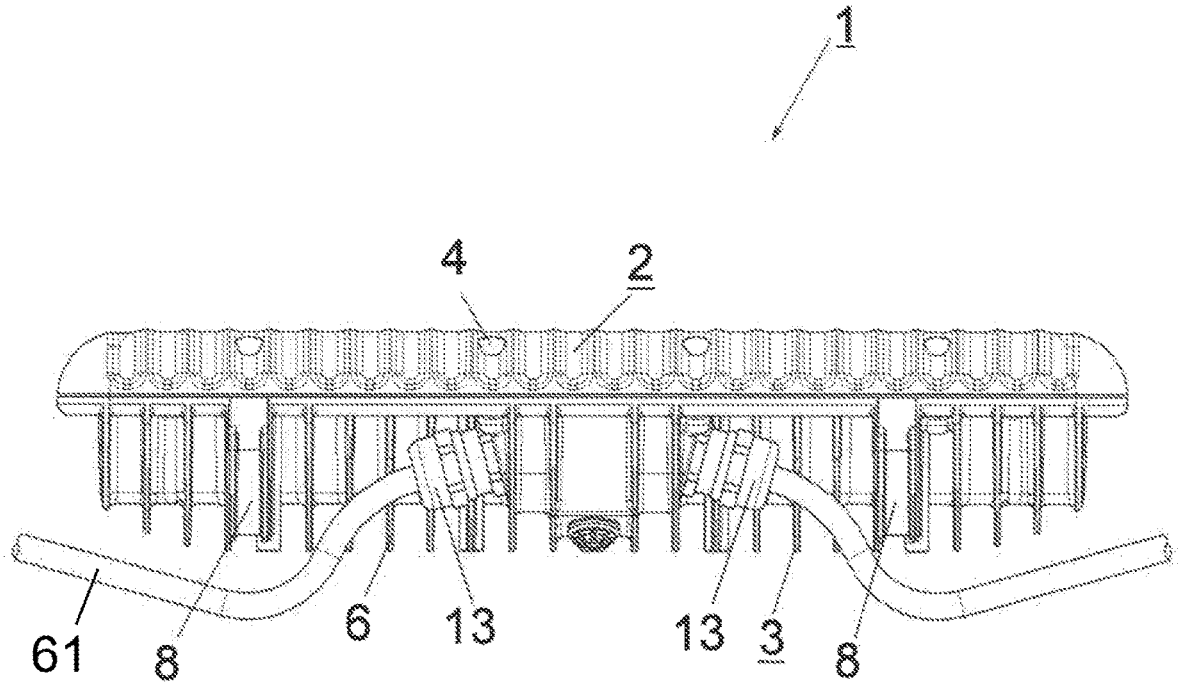
FIG. 4 shows a side view of the LED module according to FIG. 1.

FIG. 4 shows a side view of the LED module 1 with the upper plastic cover 2 and the lower heat sink 3 with a view onto the screwed connections 13 and eyelets 8. From this view, the height of the individual cooling fins 15, which have an essentially greater height compared to the plastic cover, becomes clear.

The total area of the cooling fins 15 is here designed such that the arising heat of the power LEDs arranged underneath the plastic cover 2 can be completely dissipated to the back.

Figure 5:
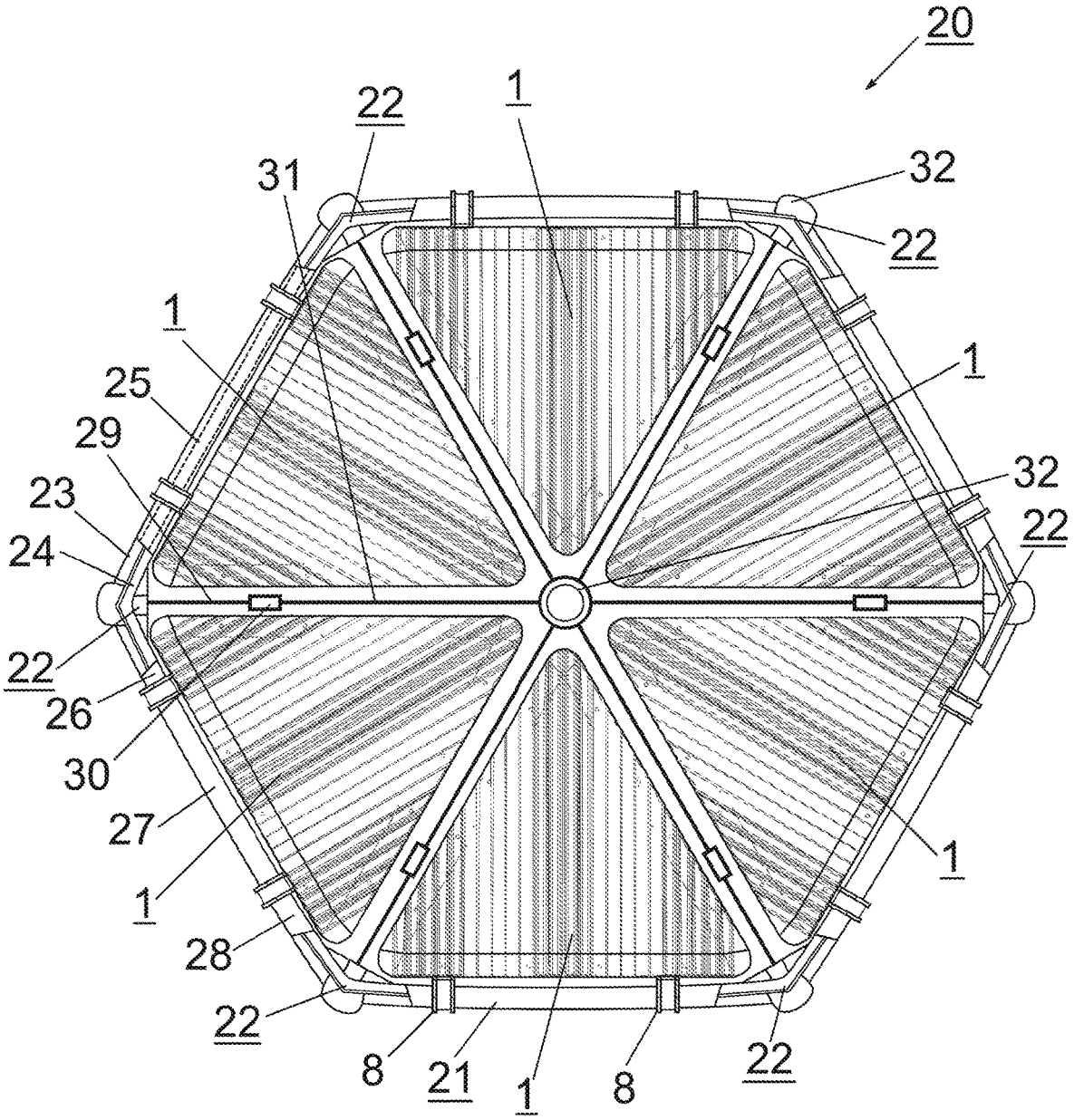
FIG. 5 shows a plan view onto a luminaire having altogether six LED modules and one retaining element in the form of a polygonal bow with corner connectors and tensioning elements.
Figure 5A:
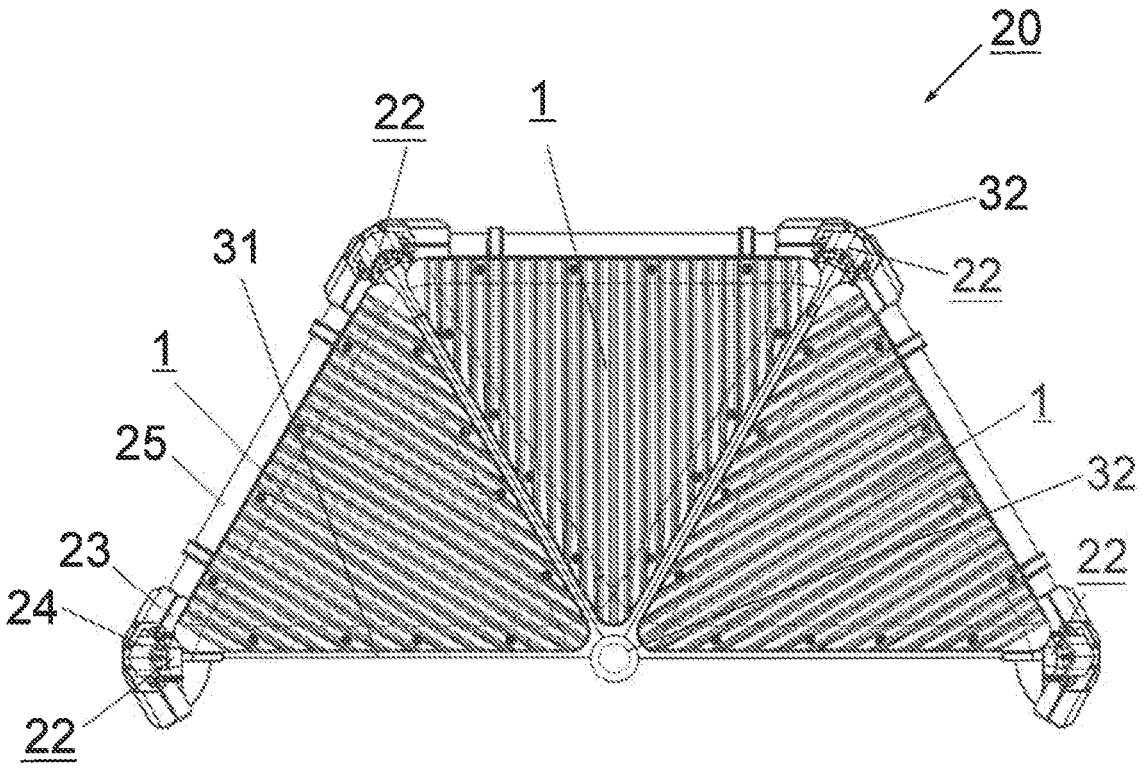
FIG. 5A shows the upper half of a luminaire with three modules.

FIG. 5 shows a plan view of a luminaire 20 with altogether six LED modules 1. The individual LED modules 1 are represented in FIGS. 1 to 4 and have been described in detail. FIG. 5 now shows an assembly of six LED modules 1 which are connected to each other via a retaining element 21 by means of the eyelets 8. The retaining element 21 consists of corner connectors 22 which are formed of two pieces, namely an outer corner connector 23 and an inner corner connector 24. The outer and inner corner connectors 23, 24 are connected to each other via non-depicted screwed joints and are provided for receiving a tube 25, one corner connector 22 each receiving two tubes 25. Just as with the luminaire 20, six LED modules 1 are employed, there are also six corner connectors 22 which are each connected to each other via a tube 25. Three tube bushings 26, 27, 28 are pushed onto the tube 25, the bushing 27 coming to rest between the two eyelets 8 of one LED module 1, while the tube bushings 26 and 28 are arranged laterally with respect to the bushings 8. By means of the tube bushings 26, 27, 28, a lateral slipping of the LED modules 1 on the tube 25 between the corner connectors 22 is prevented. The eyelets 8 are here arranged offset from the centre with respect to the LED module 1, so that optionally, two LED modules 1 can be pushed onto one tube 25 and fastened. Thereby, it is possible to enlarge the represented luminaire 20 by at least one further LED module 1, optionally by up to six further LED modules 1.

In order to absorb radial forces of the luminaire 20, each corner connector 22 is connected to a sleeve 30 via a threaded bushing 29, wherein two tensioning wires 31 connected to a bushing 32 located in the centre and diverging in a V-shape originate from the sleeve 30. The bushing 32 here is similar to a bicycle hub while the tensioning wires 31, the sleeve 30, and the threaded bushing 29 correspond to a spoke. By retensioning the corner connectors, for example, by a threaded bolt which can be screwed into the threaded bushing 29, an extremely stable ring is created which locks and secures all LED modules 1 in their respective positions. The bushing 32 furthermore serves to receive the end of a stand or the like, so that the luminaire 20 can be arranged at a desired height. Here, it is easily possible that the luminaire 20 is held by a ceiling or by a crane. However, the stand, that is height-adjustable and thus offers the possibility of placing the luminaire 20 at the desired height, has priority.

The individual LED modules 1 are here pivotable out of the plane of the luminaire 20 relative to the tube 25 and are held by a locking in the respective position. Here, it is possible that only individual LED modules 1 are pivoted, preferably the opposed LED modules 1, or that all LED modules 1 are uniformly pivoted out of the plane whereby an enlargement of the illuminated area is achieved. The locking of the individual LED modules 1 relative to the retaining element 21 can be effected, for example, by fine teeth with clamping locking means on the tube 25 or on the bushing 8, respectively.

The assembly of the luminaire 20 is effected such that first of all, the inner corner elements 24 are connected to the threaded bushing 29 via a clamping screw, which are in turn connected to the bushing 32 via the sleeve 30 and the tensioning wires 31.

The tube 25 is shifted through the eyelets 8 of the LED modules 1, wherein simultaneously, the central bushing 27 and the lateral tube bushings 26, 28 can be pushed on. Preferably, a weight-saving material is used for the tube bushings 26, 27, 28, for example, a carbon tube section. An LED module 1 connected to the tube 25 in this manner is then placed against the inner corner connectors 24 and screwed by means of the outer corner connectors 23 such that the tube 25 is retained in a clamping manner. Due to the selected screwed joint of the corner connectors 22, it is here possible to exchange an individual, optionally defective LED module 1 at any time, if this is required.

The leads of the LED modules 1 are represented in FIG. 2 and are located below the shown LED modules 1 in FIG. 5. The lead wire can here be wound up for transport over angle sections 32 radially projecting to the outside, whereby the outer dimensions of the luminaire 20 are not changed and a possibility is created to accommodate the luminaire 20 in a carrier bag.

Figure 6:
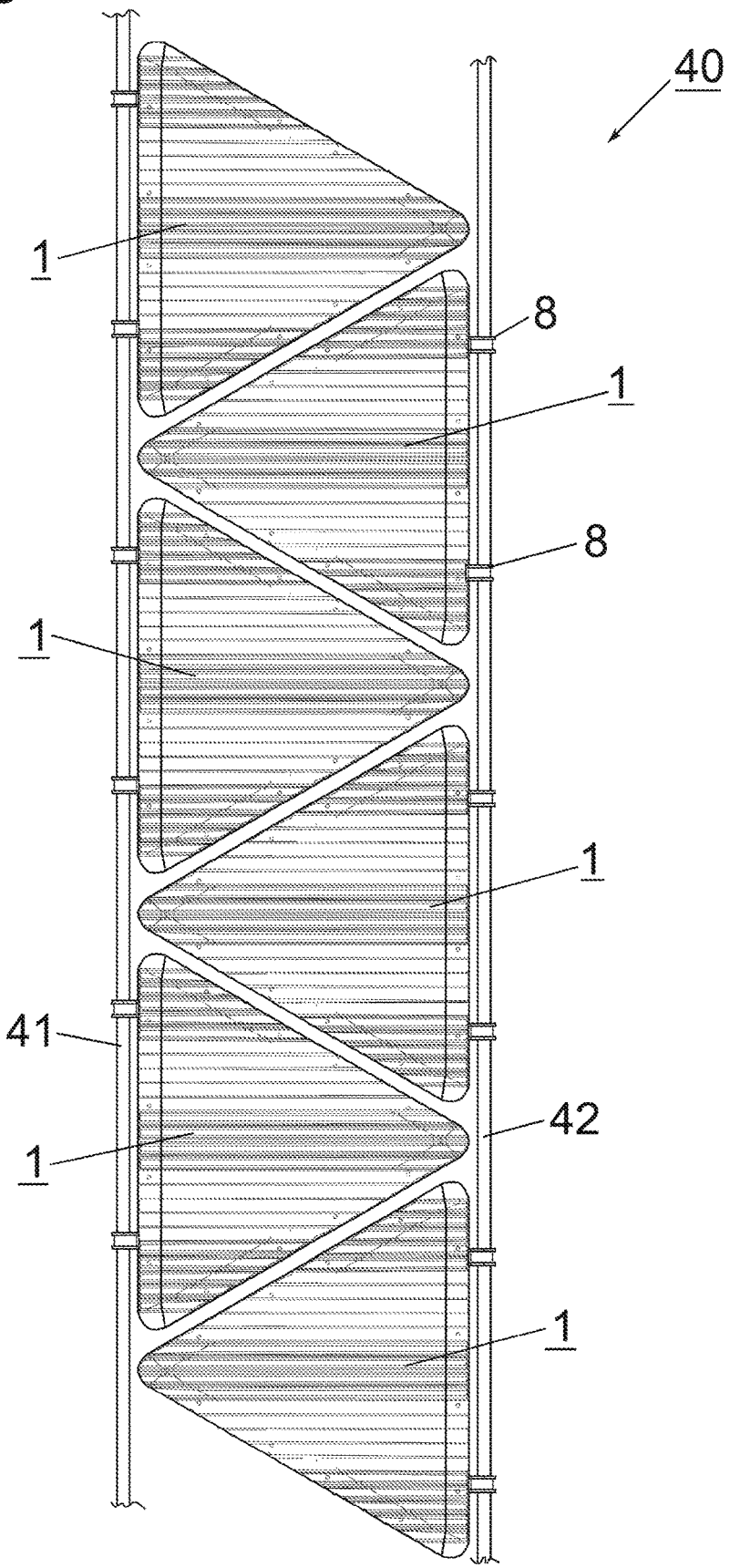
FIG. 6 shows a plan view onto a light band having a plurality of LED modules to be fastened to a wall or a ceiling.

FIG. 6 shows a plan view of a light band 40 which is provided for receiving a plurality of LED modules 1 to be fastened to a wall or ceiling. The individual LED modules 1 are pushed onto a retaining pieces 41, 42 for this purpose. The retaining pieces 41, 42 can, just as with the luminaire 20, consist of an inner tube and an outer bushing, wherein the bushings prevent a lateral shifting of the LED modules 1. In this manner, a uniform distance between the LED modules 1 can be maintained. The length of the retaining pieces 41, 42 is determined by the desired length of the light band 40, where it is easily possible that by means of a coupling or a sleeve, a plurality of individual retaining pieces 41, 42 is extended as desired. The construction of the LED modules 1 corresponds to the representation in FIGS. 1 to 4 and the pertaining description.

In case of the light band 40, the LED modules 1 are preferably arranged in one plane, where likewise a locking via fine teeth and locking means can be effected between the retaining pieces 41, 42 and the bushings 8 of the LED modules 1. Further fastening possibilities, for example by supporting the apices facing to the opposite retaining pieces 41, 42, are also conceivable for the LED modules 1. In individual cases, however, it can be desired to slightly angle the LED modules 1 out of the modules' plane so that the illuminated area can be varied.

Figure 7:
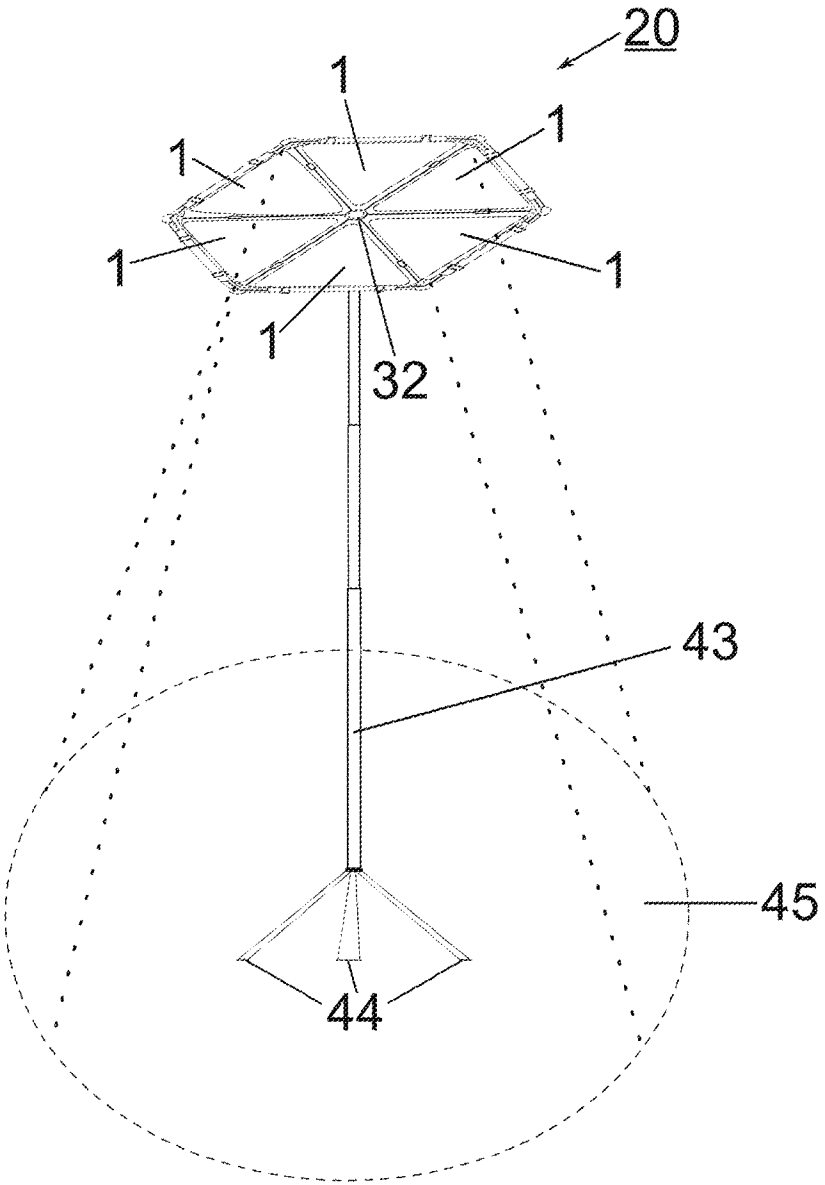
FIG. 7 shows a perspective view of a luminaire having LED modules arranged in one plane and a representation of the illuminated area.

FIG. 7 shows a perspective representation of a luminaire 20 with LED modules 1 arranged in one plane. The luminaire 20 is arranged on a stand 43 which is received in the bushing 32 and has the required stability with a tripod 44. Depending on the height of the luminaire 20, an area 45 is here illuminated which, with this deflection of the individual LED modules 1, nearly corresponds to a circle.

Figure 8:
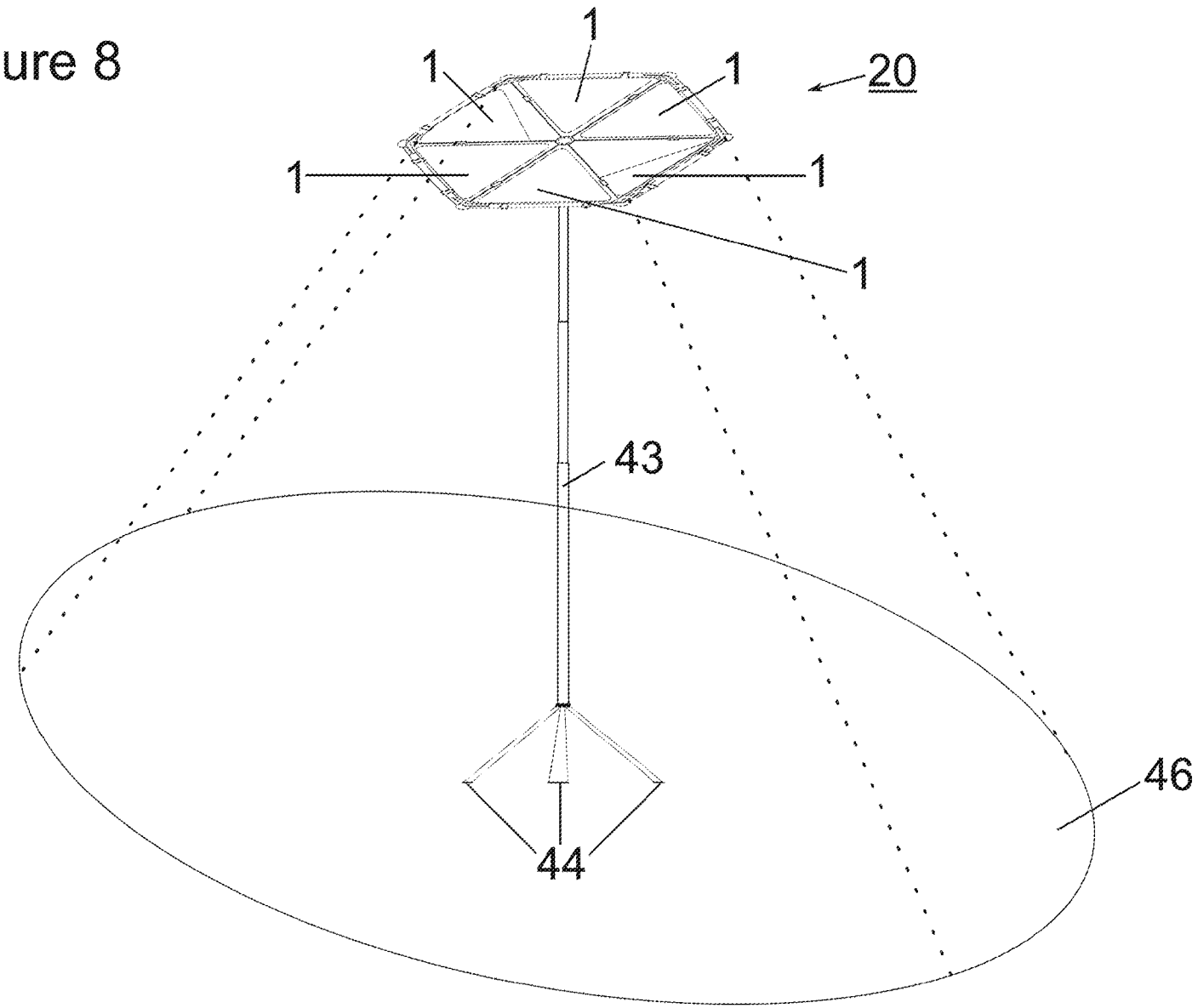
FIG. 8 shows a perspective view of a luminaire having LED modules partially folded open to the bottom and a representation of the illuminated area.

FIG. 8 shows a perspective representation of a luminaire 20 with two LED modules 1 folded open to the bottom. The luminaire also rests on a stand 43 with a tripod 44. Due to the two opposite LED modules 1 which are folded open to the bottom, a nearly elliptic area 48 is illuminated.

By folding open several LED modules 1, it is in contrast achieved that a nearly circular area with a larger diameter is illuminated. The diameter of the respective illuminated area furthermore depends on the position of the luminaire 20, the higher the position is selected by extending the stand 43, the more the illuminated area 45 or 46, respectively, is enlarged.

Figure 9:
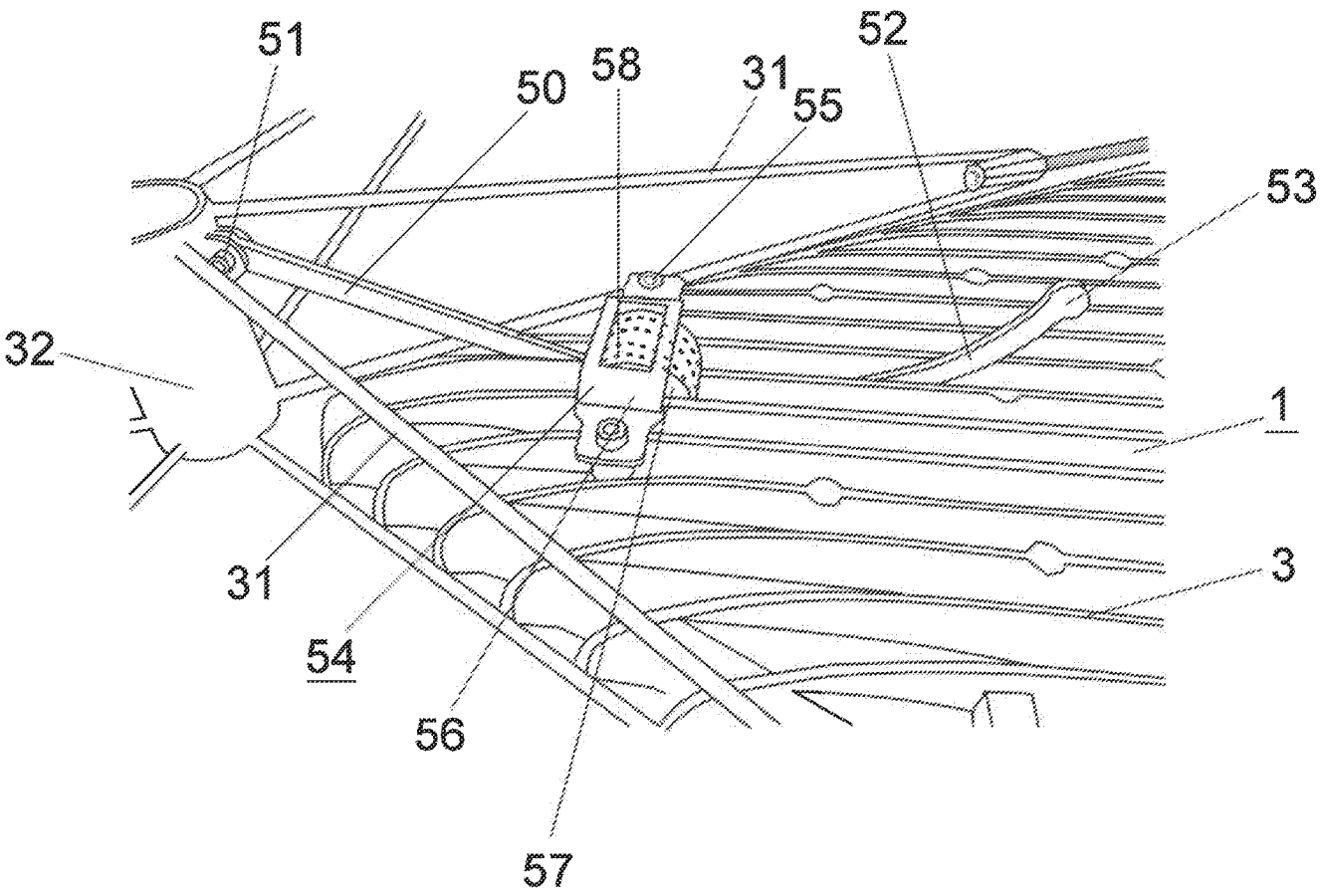
FIG. 9 shows an enlarged partial view of the bottom view of the LED module with fixing means.

FIG. 9 shows a perspective partial view of the rear side of an LED module 1.

Essentially, the heat sink 3 can be seen here, while the LEDs are arranged on the opposite side. The LED module 1 is held by tensioning wires 31 which are guided, starting from a bushing 32, to a hexagonal retaining element. The LED modules 1 are here, as already described, connected to the retaining element via eyelets.

To achieve a pivotability of the LED modules 1, a locking of the triangle apices of an LED module 1 is effected by a metal band 50 which is connected at one end to the bushing 32 via a swivel joint 51. The metal band 50 extends, starting from the swivel joint 51, initially in a straight line and passes over into a curvature 52 which has a swelling 53 on its end. The curvature 52 of the metal band 50 is required so that during a pivoting movement, the metal band 50 extends, during the complete motion sequence, between a fixing means in the form of a magnetic retainer 54. The magnetic retainer 54 is connected to the bottom side of the LED module 1 via studs 55 and essentially consists of a tab 56 with a magnet mount 57 which is represented to be round in the shown exemplified embodiment. In the magnet mount 57, two opposed permanent magnets 58, 59 are located which are fixed at a distance with respect to each other, so that the metal band 50 can slide to and fro between the permanent magnets 58, 59. The permanent magnets 58, 59 here take care that the metal band 50, and thus also the LED module 1, are securely held in any position.

The exemplified embodiment shows one of several possibilities, however, any other type of locking for the individual LED modules 1 can be provided in the luminaire.

LIST OF REFERENCE NUMERALS

1 LED module
2 plastic cover
3 heat sink
4 stud
5 elevation
6 cooling fin
7 rounding
8 eyelets
9 bore
10 edge extension
11 curvature
12 supports
13 screwed connection
15 cooling fin
20 luminaire
21 retaining element
22 corner connector
23 (external) corner connector
24 (internal) corner connector
25 tube
26 tube bushing
27 tube bushing
28 tube bushing
29 threaded bushing
30 sleeve
31 tensioning wire
32 bushing
40 light band
41, 42 retaining pieces
43 stand
44 tripod
45 area
46 area
50 metal band
51 joint
52 curvature
53 swelling
54 magnetic retainer
55 stud
56 flap
57 magnet mount
58 permanent magnet
59 permanent magnet
60 LEDs
61 cable connection

The invention claimed is:

1. Luminaire (20) comprising at least one retaining element (21), or retaining pieces (41, 42), to which at least one LED module (1) is pivotably fastened, and to which a voltage can be supplied via leads, characterized in that the at least one LED module (1) has an approximately triangular, flat basic form, a lateral surface being fitted with LEDs, and the rear side of the LED module (1) being designed to emit thermal radiation, wherein at least one side edge is fastened to the retaining element, and the retaining element (21) consists of a polygonal frame or two straight fastening supports, wherein the retaining element (21) consists of the polygonal frame extending over 180° or 360°, or the polygonal frame and a second polygonal frame, of 180° each, are connected to each other via a joint, or the retaining pieces (41, 42) consists of two fastening supports which are fixed to the wall or ceiling and hold a plurality of neighbouring LED modules (1).

2. Luminaire (20) according to claim 1, characterized in that a plurality of LED modules (1) is joined and connected to a semicircle or a full circle via the retaining element (21), or that a plurality of LED modules (1) is joined and connected in a strip form via the retaining pieces (41, 42).

3. Luminaire (20) according to claim 1, characterized in that the at least one LED module (1) can be supplied with a supply voltage via a cable connection, or that a plurality of LED modules (1) are interconnected and can be supplied with a supply voltage at least via a cable connection.

4. Luminaire (20) according to claim 1, characterized in that the at least one LED module (1) can at least partially be pivoted around the frame.

5. Luminaire (20) according to claim 1, characterized in that the LED modules (1) are oriented, after the assembly, spaced apart with respect to each other with a triangle apex towards the centre of a semicircle or a full circle, or the LED modules (1) are alternately oriented with a triangle apex in opposite directions.

6. Luminaire (20) according to claim 1, characterized in that the triangle apices can be lifted or lowered in a direction perpendicular to the LED module's plane, or the lifted triangle apices can be locked in a plurality of locking stages or continuously.

7. Luminaire (20) comprising at least one retaining element (21), or retaining pieces (41, 42), to which at least one LED module (1) is pivotably fastened, and to which a voltage can be supplied via leads, wherein the at least one LED module (1) has an approximately triangular, flat basic form, a lateral surface being fitted with LEDs, and the rear side of the LED module (1) being designed to emit thermal radiation, wherein at least at one side edge, connecting elements for the retaining element (21) are present, and the retaining element (21) consists of a polygonal frame or two straight fastening supports, characterized in that the triangle apices of one LED module (1) are locked in place via a metal band (50) which is arranged between two permanent magnets (58, 59), wherein the metal band (50) is connected to a bushing (32) via a joint (51), and the metal band (50) comprises a curvature (52) at its free end which results in a compensation movement when the LED module (1) is lifted, and the metal band (50) remains between the permanent magnets (58, 59).

8. Luminaire (20) comprising at least one retaining element (21), or retaining pieces (41, 42), to which at least one LED module (1) is pivotably fastened, and to which a voltage can be supplied via leads, wherein the at least one LED module (1) has an approximately triangular, flat basic form, a lateral surface being fitted with LEDs, and the rear side of the LED module (1) being designed to emit thermal radiation, wherein at least at one side edge, connecting elements for the retaining element (21) are present, and the retaining element (21) consists of a polygonal frame or two straight fastening supports, characterized in that the individual LED modules (1) can be set up to a pyramid or conical shape.

9. Luminaire (20) according to claim 1, characterized in that the at least one LED module (1) is equipped with eyelets (8) which receive a retaining element (21), or retaining pieces (41, 42), in the form of a tube (25), a round strut, or a round fastening support.

10. Luminaire (20) comprising at least one retaining element (21), or retaining pieces (41, 42), to which at least one LED module (1) is pivotably fastened, and to which a voltage can be supplied via leads, wherein the at least one LED module (1) has an approximately triangular, flat basic form, a lateral surface being fitted with LEDs, and the rear side of the LED module (1) being designed to emit thermal radiation, wherein at least at one side edge, connecting elements for the retaining element (21) are present, and the retaining element (21) consists of a polygonal frame or two straight fastening supports, characterized in that the retaining element (21), or retaining pieces (41, 42), consist of a round fibre, glass fibre, or carbon fibre rod, wherein the retaining elements (21) are equipped with corner connectors (22) which are connected to a bushing (32) via tensioning wires (31).

11. Luminaire (20) according to claim 1, characterized in that between corner connectors (22), a tube (25) is arranged onto which tube bushings (26, 27, 28) can be pushed for positioning the LED modules (1), wherein the LED modules (1) are equipped with two eyelets (8) laterally offset to the centre at one side edge.

12. Luminaire (20) according to claim 1, characterized in that the rear side of the LED modules (1) is equipped with cooling fins (6, 15), or the front side of the LED modules (1) is equipped with a plastic cover (2) which is provided with elevations (5) or corrugations for light scattering and to enlarge the surface.

13. Luminaire (20) according to claim 1, characterized in that the at least one LED module (1) is fitted with LEDs of different colours, in particular RGB colours, or the at least one LED module (1) can be dimmed, or the at least one LED module (1) can be controlled via a controller, preferably a GMX controller.

14. Luminaire (20) according to claim 1, characterized in that a bushing (32) is provided as fastening means for an assembly at a selected working height, wherein a stationary assembly or a variable, height-adjustable assembly via a stand (43) is performed.

* * * * *